US009868614B2

(12) United States Patent
Smith et al.

(10) Patent No.: US 9,868,614 B2
(45) Date of Patent: Jan. 16, 2018

(54) ELEVATOR SYSTEM

(71) Applicant: ThyssenKrupp Elevator AG, Essen (GB)

(72) Inventors: Rory Smith, El Cajon, CA (US); Stefan Kaczmarczyk, Northampton (GB)

(73) Assignee: Thyssenkrupp Elevator AG, Essen (DE)

( * ) Notice: Subject to any disclaimer, the term of this patent is extended or adjusted under 35 U.S.C. 154(b) by 239 days.

(21) Appl. No.: 14/635,416

(22) Filed: Mar. 2, 2015

(65) Prior Publication Data

US 2015/0246791 A1 Sep. 3, 2015

(30) Foreign Application Priority Data

Feb. 28, 2014 (EP) ..... 14157362

(51) Int. Cl.
*B66B 5/02* (2006.01)
*B66B 7/10* (2006.01)
(Continued)

(52) U.S. Cl.
CPC ..... *B66B 5/022* (2013.01); *B66B 7/06* (2013.01); *B66B 7/068* (2013.01); *B66B 7/10* (2013.01);
(Continued)

(58) Field of Classification Search
CPC ... B66B 7/10; B66B 11/0035; B66B 11/0045; B66B 5/022; B66B 7/06; B66B 7/068; B66B 5/0087
See application file for complete search history.

(56) References Cited

U.S. PATENT DOCUMENTS 2,537,075 A * 1/1951 Margles ..... B66B 7/068 187/264
5,861,084 A 1/1999 Barker et al.
(Continued)

FOREIGN PATENT DOCUMENTS

CN 1197034 A 10/1998
CN 101486427 A 7/2009
(Continued)

OTHER PUBLICATIONS

EP Application No. 14157362.6, Search Report dated Jul. 29, 2014, 6 pages.

*Primary Examiner* — William E Dondero
*Assistant Examiner* — Diem M Tran
(74) *Attorney, Agent, or Firm* — Lathrop Gage L.L.P.

(57) ABSTRACT

One elevator system includes an elevator car, counterweight, traction sheave, support wrapped around the traction sheave and suspending the car and the counterweight, a compensation sheave, a compensation member wrapped around the compensation sheave and being affixed at a first end to the elevator car and at a second end to the counterweight, and a tensioner. The support is driven by rotation of the traction sheave to raise and lower the car, and the tensioner is in communication with the traction sheave for linearly displacing a rotational centerpoint of the traction sheave. Another elevator system has an elevator car, counterweight, compensation sheave, compensation rope wrapped around the compensation sheave and being affixed to the car and the counterweight, a traction sheave driving a support suspending the car and the counterweight, and a tensioner in communication with the traction sheave for inducing a variation in tension of the compensation rope.

17 Claims, 3 Drawing Sheets

(51) Int. Cl.

| | |
|---|---|
| ***B66B 9/00*** | (2006.01) |
| ***B66B 7/06*** | (2006.01) |
| *B66B 1/30* | (2006.01) |
| *B66B 11/00* | (2006.01) |

(52) U.S. Cl.
CPC *B66B 9/00* (2013.01); *B66B 1/30* (2013.01); *B66B 11/0035* (2013.01)

(56) References Cited

U.S. PATENT DOCUMENTS

| | | | | |
|---|---|---|---|---|
| 8,123,002 | B2 * | 2/2012 | Smith | B66B 1/42 187/266 |
| 2004/0079590 | A1 | 4/2004 | Sweet | |
| 2015/0353323 | A1 * | 12/2015 | Shiraishi | B66B 5/04 187/266 |

FOREIGN PATENT DOCUMENTS

| | | | |
|---|---|---|---|
| CN | 201729553 | U | 2/2011 |
| JP | 2003104656 | A | 4/2003 |

* cited by examiner

ELEVATOR SYSTEM

RELATED APPLICATIONS

This application claims priority to European Patent Application 14157362.6, filed Feb. 28, 2014, the disclosure of which is incorporated in its entirety herein by reference.

FIELD OF THE INVENTION

The present invention relates, in general, to elevator systems and, in particular, to actively controlling the natural frequency of tension members.

BACKGROUND OF THE INVENTION

Tension members or means such as ropes and cables are subject to oscillations. These members can be excited by external forces such as wind. If the frequency of exciting forces matches the natural frequency of the tension member, then the tension member will resonate.

High velocity winds cause buildings to sway back and forth. The frequency of the building sway can match the natural frequency of the elevator causing resonance. In resonance, the amplitude of the oscillations increases unless limited by some form of dampening. This resonance can cause significant damage to both the elevator system and the structure.

Two major problems plague high rise elevators with long hoist ropes and correspondingly long compensation ropes. These are rope sway and re-leveling due to rope elongation. Rope sway, particularly compensation rope sway, is a major problem in high rise buildings.

The fundamental frequency (also called natural frequency) of a periodic signal is the inverse of the pitch period length. The pitch period is, in turn, the smallest repeating unit of a signal. The significance of defining the pitch period as the smallest repeating unit can be appreciated by noting that two or more concatenated pitch periods form a repeating pattern in the signal. In mechanical applications a tension member, such as a suspension rope, fixed at one end and having a mass attached to the other, is a single degree of freedom oscillator. Once set into motion, it will oscillate at its natural frequency. For a single degree of freedom oscillator, a system in which the motion can be described by a single coordinate, the natural frequency depends on two system properties; mass and stiffness. Damping is any effect, either deliberately engendered or inherent to a system, that tends to reduce the amplitude of oscillations of an oscillatory system.

Because of a low mass of a compensation sheave around which a compensation rope is wound, the natural frequency of the compensation ropes is very low and is normally between 0.05 Hz and 1 Hz. The following equation (Equation 1) can used be to calculate the natural frequency of compensation ropes in Hz:

$$f_n = \frac{n}{2L}\sqrt{g\left(\frac{M}{2n_c m} + \frac{L}{2}\right)} \tag{1}$$

where g=9.81 m/s$^2$ is the acceleration of gravity, n denotes the vibration mode number, $n_C$ is the number of ropes, L is the length of the rope (in m), M represents mass of the compensating sheave assembly (in kg), and m is mass of the rope per unit length (in kg/m).

High rise buildings are known to sway during windy conditions. The frequency of the building sway is generally between 0.05 and 1 Hz. Because the natural frequency of the compensation ropes is very close to the natural frequency of the building, resonance often occurs. Compensation rope resonance can cause the ropes to strike the walls and elevator doors causing damage and frightening passengers.

The U.S. Pat. No. 8,123,002 B2 discloses a system and method for minimizing compensation rope sway by altering the natural frequency of compensation ropes using servo actuators. The rope sway is minimized by moving the compensation sheave of the compensation rope to modulate tension of the compensation rope or to adjust the position of the termination of a compensation rope to account for changes in the position of a structure.

SUMMARY

The invention seeks to provide an effective and cost effective way of minimising rope sway, thus avoiding rope resonance.

Thus, an elevator system comprising the features of claim 1 is suggested. The invention provides an efficient and reliable means of minimising compensation rope sway, thus preventing compensation rope resonance effects, by providing the traction sheave with tension means for inducing a variation of the tension of the compensation rope. Advantageously, according to the present invention, rope sway may be minimized without having to manipulate a compensation sheave provided in the lower part of the shaft. Be it added that in case of the traction sheave being coaxially coupled to the shaft of the hoist motor, it is also possible to provide tension means according to the invention (such as servo actuators, as will be further detailed below) which act on the hoist motor. This is also understood to fall under the wording of the traction sheave being provided with tension means. Also, the hoist motor itself can constitute tension means for the compensation rope, for example by providing an oscillatory movement for the traction sheave, as will be further detailed below.

Advantageously, the means to induce a variation of the rope tension of the compensation rope comprises at least one servo actuator, which is adapted to adjust the position of the traction sheave. Especially, it is possible to adapt or control the vertical position of the traction sheave within the elevator shaft. For example, by means of raising the position of the traction sheave within the elevator shaft, the elevator car and the counterweight will be accordingly raised. Hereby, a compensation rope, which is wrapped about a compensation sheave in the lower part of the shaft, will be tensioned. It is also conceivable to adjust the horizontal position of the traction sheave within the elevator shaft.

Advantageously, the tension means comprise means for variation of the angular speed and/or providing an oscillatory movement of the traction sheave. These means can be embodied by the hoist motor of the elevator system, which drives the traction sheave, as mentioned.

Expediently, the elevator system comprises a controller, which is adapted to compare the natural frequency of a building structure, within which the elevator system is provided, with the natural frequency of the compensation rope, and to direct the servo actuator to adjust the position of the traction sheave, if the compared frequencies are substantially similar, especially if the difference between the determined frequencies is smaller than a predetermined threshold value. This provides a reliable criterion for evaluating at what times the variation of the tension of the compensation rope is required.

According to a further preferred embodiment, the means to induce a variation of the rope tension of a compensation rope can comprise means for adjusting the angular position and/or angular speed of the traction sheave. For example, by means of introducing a vibrational or oscillating movement of the traction sheave, the length of the compensation rope between the compensation sheave and the elevator car (and correspondingly between the compensation sheave and the counterweight) can be slightly varied leading to a modification of the tension of the compensation rope whereby rope sway can be effectively acted against.

According to a further preferred embodiment, the compensation sheave is provided in a moveable manner, wherein at least one servo actuator is provided to adjust the position, especially the vertical and/or horizontal position, of the compensation sheave. Hereby, an additional means for minimizing compensation rope sway by altering the natural frequency of the compensation rope is provided. Especially, based on the observation that the first and second vibration modes are the most problematic modes, the first mode could be counteracted by the traction sheave (and/or the hoist motor) being provided with tension means to induce a variation of the tension of the compensation rope, especially by adjusting the position of the traction sheave, as described above, and the second mode by means of adjusting the position of the compensation sheave, or vice versa.

Advantageously, the means provided with the traction sheave to induce a variation of the rope tension of the compensation rope are provided as at least one servo actuator.

Advantageously, the at least one servo actuator for adjusting the position of the traction sheave and/or the at least one servo actuator for adjusting the position of the compensation sheave is adapted to adjust the positions of traction sheave and compensation sheave respectively within defined ranges. This adjustment can be effected to ensure that the natural frequency of the compensation rope is sufficiently different from that of the building structure, within which the elevator system is provided.

Advantageous embodiments of the invention will now be described with reference to the accompanying drawings. It is to be understood that this invention is not limited to the precise arrangement shown. Especially, individual features shown in the context of the drawings and/or described with reference to the preferred embodiments shall be considered disclosed on their own or in any other feasible combination of other features thus shown.

Further advantages and embodiments of the invention will become apparent from the description and the appended figures.

It should be noted that the previously mentioned features and the features to be further described in the following are usable not only in the respectively indicated combination, but also in further combinations or taken alone, without departing from the scope of the present invention.

DETAILED DESCRIPTION

Figure 1:
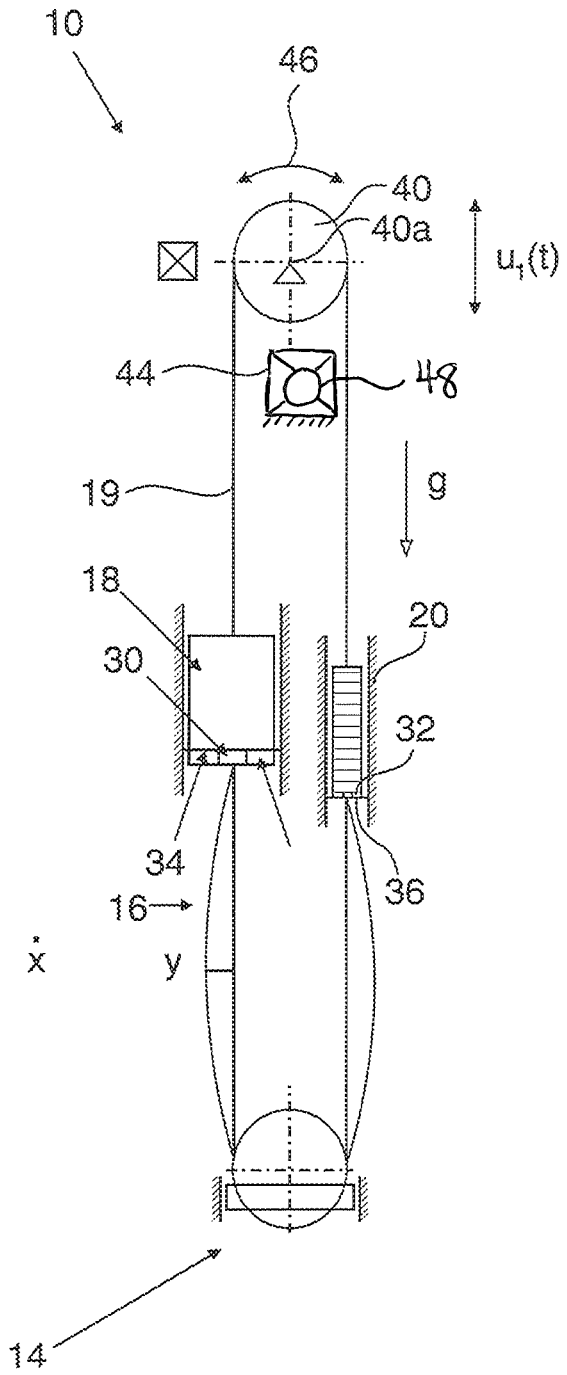
FIG. 1 illustrates a first preferred embodiment of an elevator system according to the invention.

Referring to FIG. 1, a general design of an elevator system 10 is shown. It comprises an elevator car 18 and a counterweight 20, which are connected to one another via a hoist rope 19 constituting a suspension (support) means. Obviously, the suspension means could be embodied as a plurality of hoist ropes, or belts.

The hoist rope 19 is wrapped around a traction sheave 40, which is driven by a hoist motor 42, which is shown purely schematically. Especially the hoist motor 42 can be provided coaxially with respect to a shaft 40*a* of traction sheave 40, e. g. in the view of FIG. 1 behind the traction sheave.

The elevator system 10 comprises one or more servo actuators 44 interacting with the traction sheave 40. In case of a coaxial arrangement of traction sheave and hoist motor the servo actuator(s) can interact with the hoist motor. The servo actuator 44 is configured to move the traction sheave vertically within a predetermined range $u_1(t)$. Such a vertical movement has to be performed at as suitable frequency and amplitude, preferably according to suitable feedback control algorithms.

Also, by means of hoist motor 42, which under normal operating conditions serves to rotate the traction sheave 40 in one angular direction over a sufficient period of time to transport elevator car 18 e.g. from a first landing to a second landing, the traction sheave 40 can perform a rotational oscillatory movement. This is symbolized by double arrow 46. Such an oscillatory movement has to be performed at a suitable frequency and amplitude, again according to suitable feedback control algorithms. Typically there will be different frequencies and angular displacements depending on specific operating conditions. For example, when the elevator car is moving, the rope length continuously changes, which leads to a corresponding continuous change in its natural frequency. Thus, during such movement, there is less time for the rope displacement to grow with resonance.

However, when the elevator car stops moving, i.e. is in a stationary position, the length and thus the natural frequency of the rope will be constant, and the displacement amplitudes will be able to increase. Therefore, in case of a moving elevator car, smaller compensation frequencies as well as angular displacements of the traction sheave will be sufficient, whereas larger compensation frequencies and angular displacements will be expedient in case of a stationary elevator car.

The elevator car 18 and the counterweight 20 are also connected by means of a compensation rope 16, which is wrapped around a compensation sheave 14 in the lower part of the elevator shaft. The compensation rope 16 is fixed at a first end to the underside of the elevator car 18, and at a second end to the underside of the counterweight 20.

The compensation rope 16 may be affixed to the elevator 18 and/or counterweight 20 with a rope tension equalizer such as that described, for example, in U.S. Pat. No. 8,162,110. Any suitable rope, such as aramid or wire rope, may be used in accordance with versions described herein. In one version, rope having a relatively high natural frequency may be used.

The position of the compensation rope 16 relative to the building is also a factor in determining whether resonance will occur. Referring again to FIG. 1, the compensation rope 16 may be attached to terminations on the bottom of the elevator car 18 and/or counterweight 20 associated with a first moveable carriage 30 and a second moveable carriage 32, respectively. In one version, the first and second moveable carriages are moveable in both the front to back (X) and side to side directions (Y). Attached to the carriage are a plurality of servo actuators 34, 36 that move the first and second moveable carriages in the X and Y directions. Movement of the location of the termination of the compensation rope 16 may help prevent the elevator system 10 from entering into resonance with the building by shifting the frequency of the compensation rope 16.

In the version of the elevator system 10 shown in FIG. 1, one or more servo actuators 44, as described above, are modulated in response to a control algorithm that actively damps the oscillation of the ropes by varying the tension in the compensation ropes by means of manipulation of the traction sheave 40. The term "tendon control" in this connection refers to actively adjusting the tension or active suppression of a tension member or compensation rope to alter the natural frequency of the tension member.

The servo actuator 44 may be a servomotor, servomechanism, or any suitable automatic device that uses a feedback loop to adjust the performance of a mechanism in modulating tendon control. The actuators could be hydraulic piston and cylinders, ball screw actuators, or any actuator commonly used in the machine tool industry. In particular, the servo actuator 44 may be configured to control the mechanical position of the traction sheave 40 along a vertical axis by creating a mechanical force to urge the traction sheave 40 in a generally upward or downward direction. Mechanical forces may be achieved with an electric motor, hydraulics, pneumatics, and/or by using magnetic principles.

In one version, the servo actuator 44 operates on the principle of negative feedback, where the natural frequency of the compensation rope 16 is compared to the natural frequency of the building as measured by any suitable transducer or sensor. A controller 48 associated with the servo actuator 44 may be provided with an algorithm to calculate the difference between the natural frequency of the compensation rope 16 and the natural frequency of the building. If the difference between these frequencies is within a predetermined range, the controller may instruct the servo actuator 44 to adjust the position of the traction sheave 14 and thus, for example, the tension of the compensation rope 16 so that any swaying motion of the rope is actively damped. It will be appreciated that any suitable feedback control theory may be applied to versions described herein.

In one version, to measure the natural frequency of a building, an accelerometer is positioned in the elevator machine room or any other suitable position, for example in the elevator shaft, and the output of the accelerometer is twice integrated to produce displacement. During periods of high velocity winds the building will sway. The twice integrated output of the accelerometer may be used to determine the displacement of the machine room from its normal location.

Several control strategies can be applied to affect tendon control such as, for example, bilinear control, positive integral force feedback, exponential stabilization, proportional, integral, and derivative (PID) feedback, and fuzzy logic control. Any suitable control means may be associated with the controller to modulate the natural frequency of the compensation rope 16. Any suitable active vibration control (AVC) techniques involving actuators to generate forces and applying them to the structure in order to reduce its dynamic response may be utilized.

Figure 2:
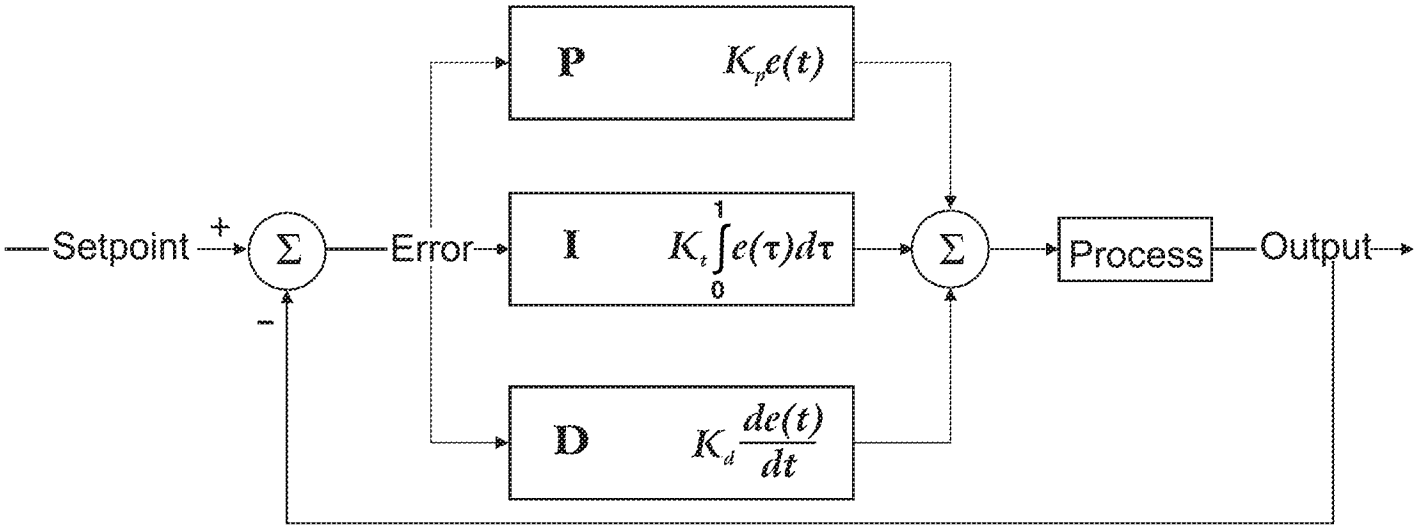
FIG. 2 illustrates a preferred version of a PID controller that may be used in association with the elevator system of FIG. 1.

Referring to FIG. 2, the rope sway may be modulated, for example, by a PID controller that monitors the natural frequencies of the compensation rope 16 and the building to prevent resonance. Modulating the natural frequency of the compensation rope 16 in the disclosed manner allows for the tension member to be actively damped. FIG. 2 illustrates a schematic of one version of a proportional-integral-derivative controller or "PID controller" that may be used to actively damp a tension member. The PID controller may be implemented in software in programmable logic controllers (PLCs) or as a panel-mounted digital controller. Alternatively, the PID controller may be an electronic analog controller made from a solid-state or tube amplifier, a capacitor, and a resistance. It will be appreciated that any suitable controller may be incorporated, where versions may use only one or two modes to provide the appropriate system control. This may be achieved, for example, by setting the gain of undesired control outputs to zero to create a PI, PD, P, or I controller.

It will be appreciated that any suitable modifications to the PID controller may be made including, for example, providing a PID loop with an output deadband to reduce the frequency of activation of the output. In this manner the PID controller will hold its output steady if the change would be small such that it is within the defined deadband range. Such a deadband range may be particularly effective for actively damping tension members where a precise setpoint is not required. The PID controller can be further modified or enhanced through methods such as PID gain scheduling or fuzzy logic.

Figure 3:
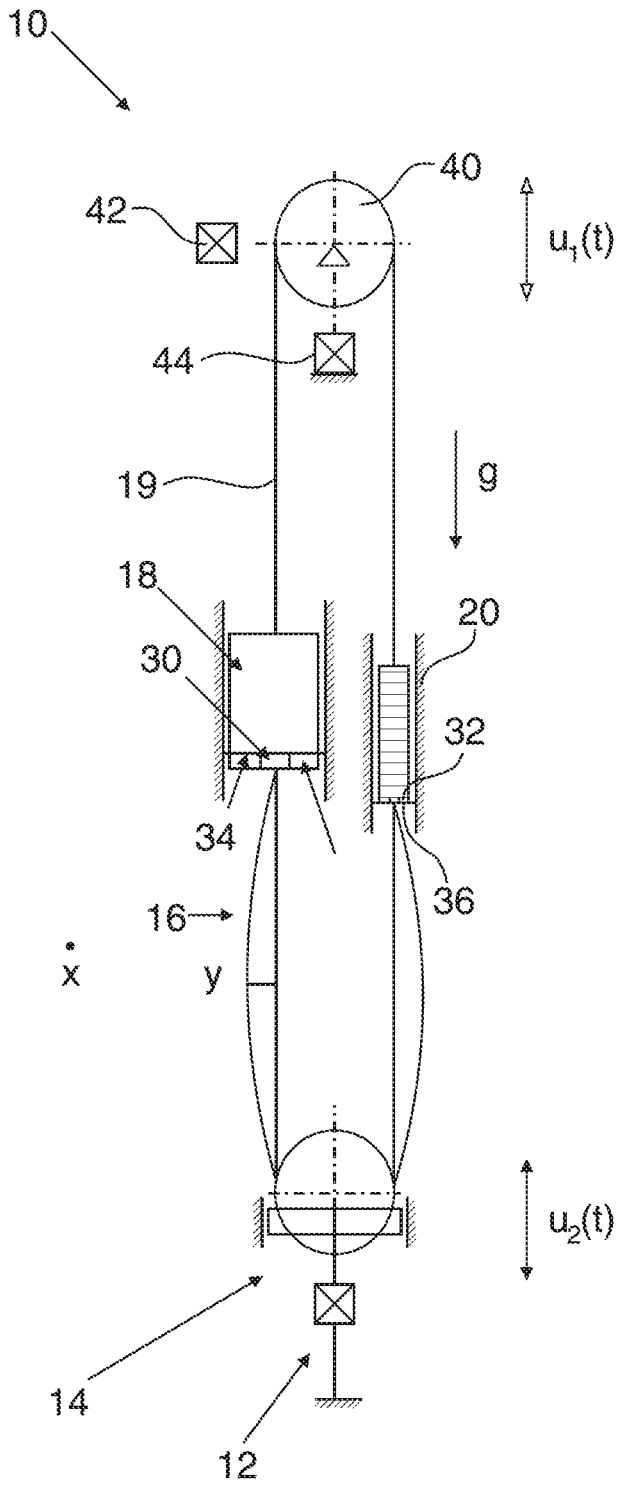
FIG. 3 illustrates a second preferred embodiment of an elevator system according to the invention.

Referring now to FIG. 3, a further preferred embodiment of the invention is shown, which comprises an adjustable traction sheave 40 as described in connection with FIG. 1, as well as an adjustable compensation sheave 14, provided in the lower part of the elevator shaft.

This embodiment differs from the embodiment of FIG. 1 only in that compensation sheave 14 is also moveable by means of at least one servo-actuator 12. Thus, parts already described with reference to FIG. 1 are provided with the same reference numerals. The servo actuator 12 is configured to move the compensation sheave 14 vertically within a predetermined range $u_2(t)$. It is also possible to move compensation sheave 14 horizontally.

All observations made above with respect to the traction sheave 40 are also applicable to the compensation sheave 14. Especially, the actuator 12 can be modulated in response to a control algorithm that actively dampens oscillation of the compensation ropes. Here again, the servo actuator 12 may be a servo motor, servo mechanism or any other suitable automatic device that uses a feedback loop to adjust the performance of a mechanism in modulating tendon control. Again, the actuators can be hydraulic pistons and cylinders, or any other embodiment as described above. The servo actuator 12 can also operate on the principle of negative feedback, as described above.

Especially, it is advantageously possible to provide a controller associated with the servo actuators 44 and 12, and provide this with an algorithm to calculate the difference between the natural frequency of the compensation rope 16 and the natural frequency of the building, as described above.

The described adjustment of the traction sheave and of the compensation sheave can advantageously be combined, for example in that adjustment of the traction sheave serves to address a first vibration made of the compensation rope, and adjustment of the compensation sheave to address the second vibration mode, or vice versa.

We claim:

1. An elevator system, comprising:
an elevator car;
a counterweight;
a compensation sheave;
a compensation rope affixed at a first end to the elevator car and at a second end to the counterweight, the compensation rope being wrapped around the compensation sheave;
a traction sheave driving a support suspending the elevator car and the counterweight; and
a tensioner connected with the traction sheave for moving the traction sheave from an initial position to induce a variation in tension of the compensation rope.

2. The elevator system of claim 1, wherein the tensioner comprises a servo actuator configured to adjust a position of the traction sheave.

3. The elevator system of claim 1, wherein the tensioner comprises a hydraulic piston configured to adjust a position of the traction sheave.

4. The elevator system of claim 1, wherein the tensioner comprises a motor configured to do at least one of:
(a) vary an angular speed of the traction sheave; or
(b) provide an oscillating angular movement of the traction sheave.

5. The elevator system of claim 1, wherein the tensioner comprises means for adjusting a height of the traction sheave and means for rotating the traction sheave.

6. The elevator system of claim 5, further comprising a controller adapted to:
(a) compare: (1) a natural frequency of a building structure housing the elevator car, and (2) a natural frequency of the compensation rope; and
(b) when the compared frequencies in step (a) are within a predetermined threshold, direct the tensioner to induce a variation in tension of the compensation rope.

7. The elevator system of claim 1, further comprising another tensioner in communication with the compensation sheave for adjusting a position of the compensation sheave.

8. The elevator system of claim 1, further comprising a controller adapted to:
(a) compare: (1) a natural frequency of a building structure housing the elevator car, and (2) a natural frequency of the compensation rope; and
(b) when the compared frequencies in step (a) are within a predetermined threshold, direct the tensioner to induce a variation in tension of the compensation rope.

9. An elevator system, comprising:
an elevator car;
a counterweight;
a traction sheave;
a support wrapped around the traction sheave and suspending the elevator car and the counterweight, the support being driven by rotation of the traction sheave to raise and lower the elevator car;
a compensation sheave;
a compensation member affixed at a first end to the elevator car and at a second end to the counterweight, the compensation member being wrapped around the compensation sheave; and
a first tensioner connected with the traction sheave for linearly displacing a rotational center point of the traction sheave from an initial position to induce tension of the compensation rope.

10. The elevator system of claim 9, further comprising a second tensioner in communication with the compensation sheave for linearly displacing a rotational center point of the compensation sheave.

11. The elevator system of claim 10, further comprising a controller adapted to:
(a) compare: (1) a natural frequency of a building structure housing the elevator car, and (2) a natural frequency of the compensation member;
(b) when the compared frequencies in step (a) are within a first predetermined threshold, direct the first tensioner to linearly displace the rotational center point of the traction sheave; and
(c) when the compared frequencies in step (a) are within a second predetermined threshold, direct the second tensioner to linearly displace the rotational center point of the compensation sheave.

12. The elevator system of claim 11, wherein:
the first tensioner includes at least one item selected from the group consisting of a hydraulic piston and a ball screw actuator; and
the second tensioner includes at least one item selected from the group consisting of a hydraulic piston and a ball screw actuator.

13. The elevator system of claim 12, wherein the support comprises at least one rope, and wherein the compensation member includes at least one rope.

14. The elevator system of claim 9, further comprising a controller adapted to:
(a) compare: (1) a natural frequency of a building structure housing the elevator car, and (2) a natural frequency of the compensation member; and
(b) when the compared frequencies in step (a) are within a predetermined threshold, direct the first tensioner to linearly displace the rotational center point of the traction sheave.

15. A suspension system for use with an elevator car and a counterweight, the suspension system comprising:
a traction sheave;
a support wrapped around the traction sheave and suspending the elevator car and the counterweight, the support being driven by rotation of the traction sheave to raise and lower the elevator car;
a compensation sheave;
a compensation member affixed at a first end to the elevator car and at a second end to the counterweight, the compensation member being wrapped around the compensation sheave;
means for monitoring a frequency of the support; and
means for actively controlling the frequency of the support by inducing a variation in tension of the compensation rope through at least one of: (a) linearly displacing a rotational center point of the traction sheave from an initial position, (b) varying an angular speed of the traction sheave, or (c) providing an oscillating angular movement of the traction sheave.

16. The suspension system of claim 15, wherein the means for monitoring a frequency of the support is an accelerometer.

17. The suspension system of claim 16, wherein the means for actively controlling the frequency of the support is:
a tensioner connected with the traction sheave; and
a controller in data communication with the accelerometer and the tensioner for selectively actuating the tensioner based on data from the accelerometer.

* * * * *